US006332551B1

(12) United States Patent
Copeland

(10) Patent No.: US 6,332,551 B1
(45) Date of Patent: Dec. 25, 2001

(54) SELF-SEALING CONTAINER

(76) Inventor: Stephan Copeland, 3000 Wesley Ave., Ocean City, NJ (US) 08226

( * ) Notice: Subject to any disclaimer, the term of this patent is extended or adjusted under 35 U.S.C. 154(b) by 0 days.

(21) Appl. No.: 09/433,261

(22) Filed: Nov. 4, 1999

Related U.S. Application Data

(60) Provisional application No. 60/107,849, filed on Nov. 10, 1998.

(51) Int. Cl.[7] ..... B65D 43/18

(52) U.S. Cl. ..... 220/262; 220/820; 220/821; 220/823; 220/824

(58) Field of Search ..... 220/252–256, 220/262–264, 908, 909, 820–824, FOR 194; 222/548, 555; 239/58, 59; 215/322, 236

(56) References Cited

U.S. PATENT DOCUMENTS

| | | | | |
|---|---|---|---|---|
| 1,998,373 | * | 4/1935 | Love | 220/820 X |
| 3,563,368 | * | 2/1971 | McHugh | 220/256 X |
| 4,164,301 | * | 8/1979 | Thayer | 220/253 |
| 4,585,151 | * | 4/1986 | Luker | 222/555 X |
| 5,072,849 | * | 12/1991 | Blau | 220/253 |
| 5,193,704 | * | 3/1993 | Kick | 220/253 |
| 5,242,075 | * | 9/1993 | Ott et al. | 220/253 X |
| 5,518,134 | * | 5/1996 | Liu | 220/820 X |
| 5,632,394 | * | 5/1997 | Mecca et al. | 220/820 X |
| 5,921,425 | * | 7/1999 | Markey | 220/254 |
| 5,954,241 | * | 9/1999 | Huang | 220/253 X |
| 6,003,711 | * | 12/1999 | Bilewitz | 220/254 X |

* cited by examiner

*Primary Examiner*—Nathan J. Newhouse
(74) *Attorney, Agent, or Firm*—Mirick, O'Connell, DeMallie & Lougee, LLP

(57) ABSTRACT

An improved container, comprising, a receptacle having at least one opening; and a lid adapted to releasably cover at least a portion of the receptacle opening, comprising, one or more lower leaves having one or more ports, through which at least a portion of the receptacle opening may be accessed and having a perimeter defining a plane; one or more upper leaves, which, in a closed position, covers one or more of the ports and which, in an open position, exposes at least a portion of one or more of the ports, wherein one or more of the upper leaves, when in an open position, is adapted to return automatically to a closed position by a means for rotating about an axis which is substantially perpendicular to the plane.

16 Claims, 13 Drawing Sheets

SELF-SEALING CONTAINER

This application claims priority to U.S. Provisional Application No. 60/107,849 filed on Nov. 10, 1998.

FIELD OF THE INVENTION

This invention relates to refuse containers and more specifically to a container with a lid that automatically recloses.

BACKGROUND OF THE INVENTION

Although refuse containers are available in many shapes and sizes, these many shapes and sizes do not provide a means for disposing of refuse that is adequately sanitary, user friendly and maintains the refuse in the manner relatively free from view once disposed. For example, the most basic refuse container with a lid consists of a receptacle with a hat-like lid that must be lifted using a knob or handle to throw waste into the receptacle. This design requires two hands and undesirably exposes the contents of the receptacle and may release odors associated with waste.

Another typical refuse container consists of a receptacle with a prism-shaped lid having a door that swings to and fro on a horizontal axis and is accessible from two sides. Although this design minimizes unwanted odors, does not unnecessarily expose the already disposed of waste and generally requires only one hand to push back the door, the refuse, as well as the user's hand which follows, invariably contacts the outside of the door, rendering this design unsanitary.

Yet another commonly used refuse container consists of a receptacle with a dome-shaped or square-shaped lid having a spring-loaded door which must be firmly pushed inward to dispose of waste. Similar to the prism-shaped container, although this design reduces unwanted odors and keeps the refuse relatively free from view, the refuse, as well as the user's hand which follows, invariably contacts the outside of the door, rendering this design unsanitary. Oftentimes, the resistance of these spring-loaded doors is so high that an inordinate amount of pressure is required to push the door open and the user's hand frequently becomes trapped or otherwise pinched between the door and the inside surface of the container. Typically the user must use a second hand to hold the door open while dropping the waste in the container to prevent the door from prematurely closing. Furthermore, the user's hand necessarily must enter the container to an extent necessary to drop the waste in the receptacle.

SUMMARY OF THE INVENTION

It is therefore a primary object of this invention to provide a container that is sanitary and self-closing.

It is a further object of this invention to provide a lid for a refuse container that is sanitary and self-closing.

It is a further object of this invention to provide a refuse container that reduces odors, conceals unsightly waste already in the container, facilitates one-handed disposal and minimiizes contact between the user's hands and the refuse already in the container.

A preferred embodiment of the improved container of the invention, comprises: a receptacle having at least one opening; and a lid adapted to releasably cover at least a portion of the receptacle opening, comprising, one or more lower leaves having one or more ports, through which at least a portion of the receptacle opening may be accessed and having a perimeter defining a plane; one or more upper leaves, which, in a closed position, covers one or more of the ports and which, in an open position, exposes at least a portion of one or more of the ports, wherein one or more of the upper leaves, when in an open position, is adapted to return automatically to a closed position by a means for rotating about an axis which is substantially perpendicular to the plane. One or more of the upper leaves may further comprise an upper axle assembly and one or more of the lower leaves may further comprise a lower axle assembly adapted to receive at least a portion of the upper axle assembly. The means for rotating may comprise a ramp fixed to the lower leaf and a wheel, fixed to the upper leaf, adapted to roll up the ramp as the upper leaf is moved to the open position and to roll down the ramp to the closed position. In effect, the upper leaf is raised and lowered due to the spiraling action of the means for rotating as it rolls up and down the ramp which spirals around the axis of the leaves. An energy absorbing member may also be provided on the ramp to slow down the upper leaf's rate of return to a closed position.

A depression may be provided in the lower leaf for receiving the wheel when the upper leaf is in the closed position to releasably maintaining the upper leaf in the closed position and a trough may be provided in the upper leaf for receiving the wheel when the upper leaf is in an open position for releasably maintaining the upper leaf in the open position.

The upper axle assembly preferably comprises an axle along the axis and the lower axle assembly comprises an axle supporting member, wherein the an axle supporting member comprises a bore adapted to receive at least a portion of the axle.

Alternatively the means for rotating may comprise an extension spring having two opposing ends, wherein one end is secured to the lower leaf and the other end is secured to the upper leaf; a ramp fixed to the lower leaf; and a tooth member, fixed to the upper leaf and adapted to slide up the ramp as the upper leaf is moved to the open position and to slide down the ramp to the closed position. Similarly, lower leaf may further comprises a depression for receiving the tooth member when the upper leaf is in the closed position to releasably maintaining the upper leaf in the closed position; and the upper leaf may further comprise a trough for receiving the tooth member when the upper leaf is in an open position for releasably maintaining the upper leaf in the open position. The upper axle assembly preferably comprises an axle along the axis and the lower axle assembly comprises an axle support member, wherein the axle support member preferably comprises a bore. The container may also be provided with a locking fastener provided with a shoulder and adapted to pass through the bore of the axle support member and fix to the upper axle assembly; and a compression spring provided about a portion of the locking fastener and juxtaposed between the shoulder and the axle support member.

The lid of the container of the preferred embodiment may further comprise one or more of the following: a means to prevent the upper leaf from over rotating, wherein the means to prevent the upper leaf from over rotating preferably comprises an interference member fixed to the upper leaf and a back stop provided in the lower leaf; and one or more security baffles.

Another preferred embodiment of the container of the invention comprises: a receptacle having at least one opening; and a lid adapted to releasably cover at least a portion of the receptacle opening, comprising, one or more lower leaves having one or more ports, through which at least a portion of the receptacle opening may be accessed and having a perimeter defining a plane; one or more upper leaves, which, in a closed position, covers one or more of the ports and which, in an open position, exposes at least a portion of one or more of the ports, wherein one or more of the upper leaves, when in an open position, is adapted to return automatically to a closed position by a means for rotating about an axis which is substantially perpendicular to the plane; wherein one or more of the upper leaves comprises an upper axle assembly and a wheel fixed to the upper leaf; and wherein one or more of the lower leaves further comprises a lower axle assembly adapted to receive at least to a portion of the upper axle assembly and a ramp fixed to the lower leaf so that the wheel is adapted to roll up the ramp as the upper leaf is moved to the open position and to roll down the ramp to the closed position. The upper axle assembly preferably comprises an axle along the axis and the lower axle assembly comprises a bore adapted to receive at least a portion of the axle.

The lower leaf may further comprise a depression for receiving the wheel when the upper leaf is in the closed position to releasably maintaining the upper leaf in the closed position; and wherein the upper leaf further comprises a trough for receiving the wheel when the upper leaf is in an open position for releasably maintaining the upper leaf in the open position.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The container of the invention is adapted to automatically close and to self-seal upon closure. More specifically, the invention includes a receptacle and a unique lid comprising an upper leaf and a lower leaf which are joined along a vertical axis assembly which enables the top leaf to rotate about the vertical axis when opening and closing. In the first embodiment described below, after being rotated to an open position, the upper leaf recloses and self-seals by a gravity driven mechanism. The second preferred embodiment closes and self-seals by a spring-loaded mechanism which causes the upper leaf to spiral about the axis of the leaves. In both of the preferred embodiments, the upper leaf is effectively raised and lowered due to the spiraling action of the means for rotating as it rolls up and down the ramp which spirals around the axis of the leaves. The spiraling action may be upward and downward or inward and outward depending on the orientation of the leaves relative to the receptacle.

Figure 1A:
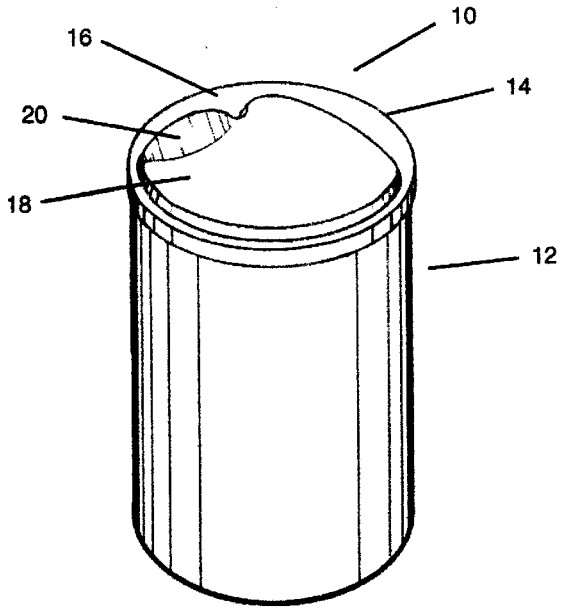
FIG. 1A is a perspective view of a preferred embodiment of the container of the invention.
Figure 1B:
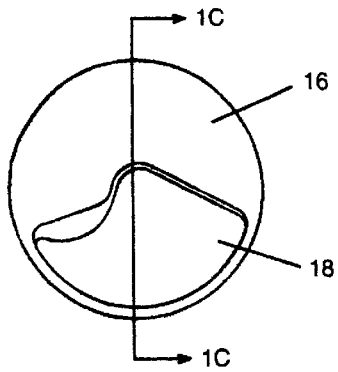
FIG. 1B is a top view of the container of FIG. 1A.
Figure 1C:
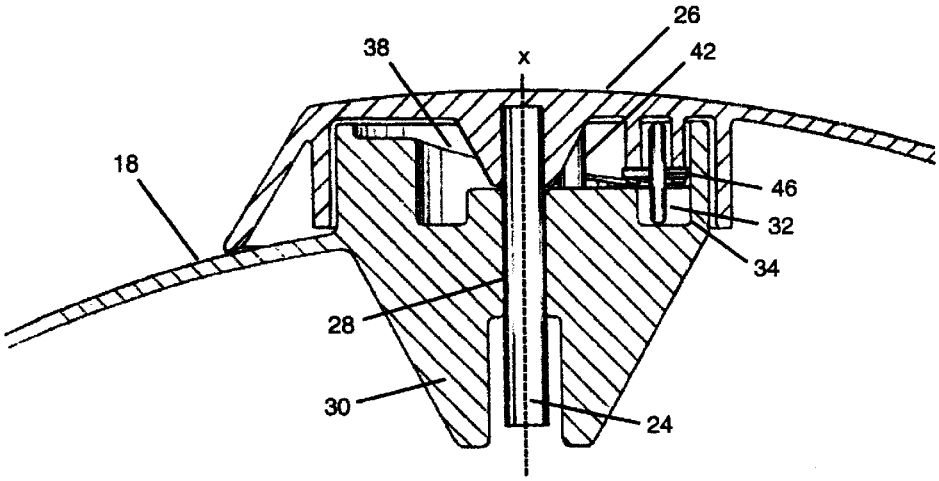
FIG. 1C is an enlarged partial cross-sectional view of the container of FIG. 1B.
Figure 2A:
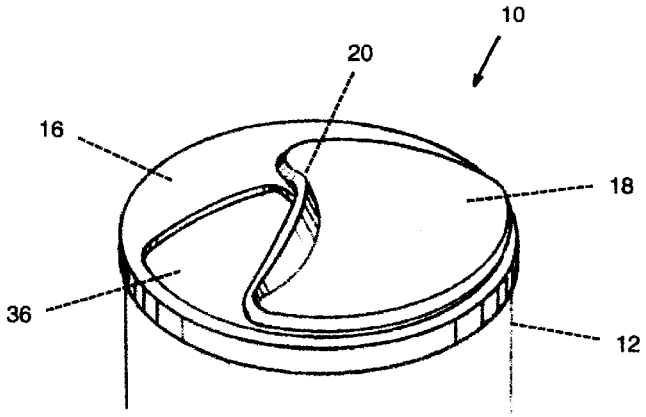
FIG. 2A is a partial perspective view of the container of FIG. 1A, partially opened.
Figure 16:
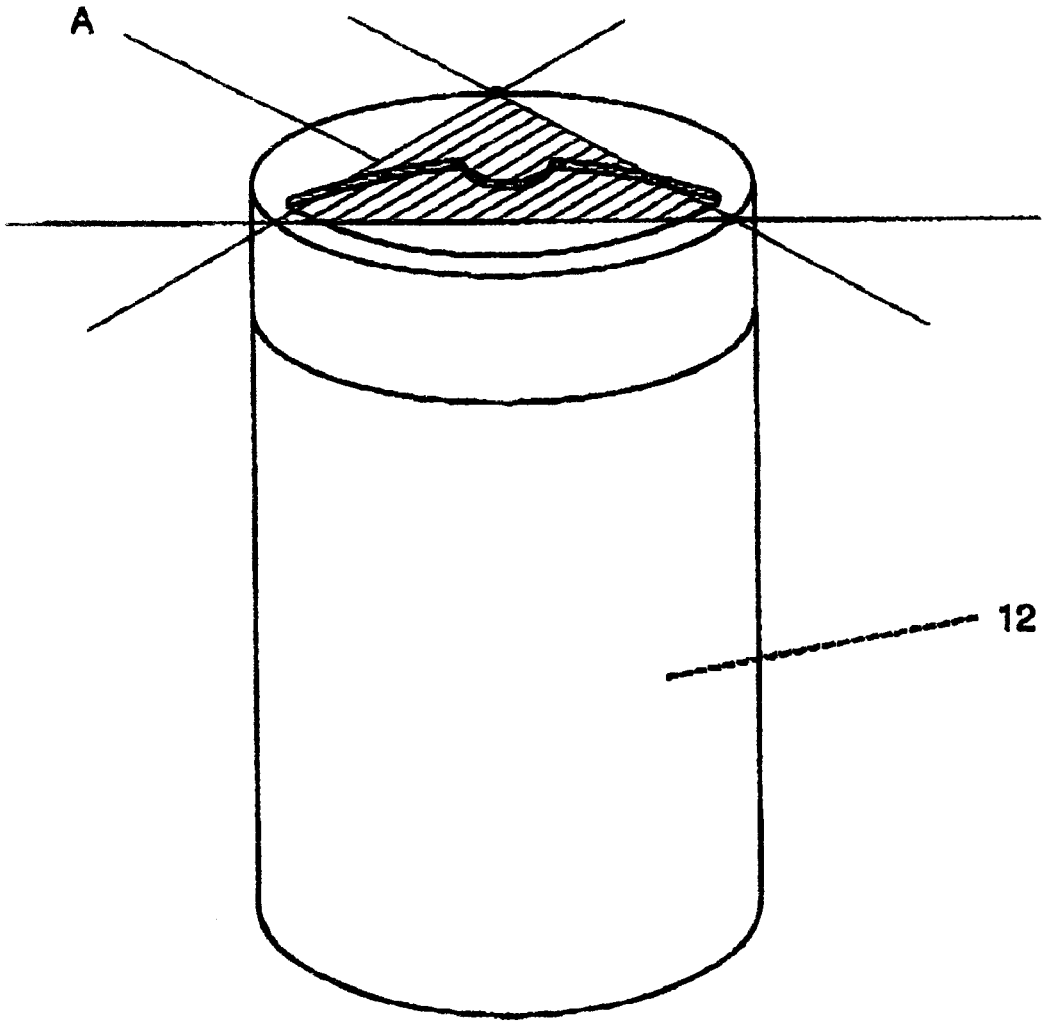
FIG. 16 is a perspective view of the container illustrating an example of plane A as defined by the perimeter of the lower leaf.

FIGS. 1 and 2 show a preferred embodiment of the container of the invention, which closes and self-seals by a gravity driven mechanism, generally referred to as container 10 and which is generally intended for, although not limited to, use as a refuse container. Container 10 is characterized by receptacle 12 having a opening (not shown) and lid 14 which covers the opening of receptacle 12. Lid 14 has a lower leaf 16 and an upper leaf 18 with handle 20. The perimeter of lower leaf 16 generally follows the shape of the upper edge of receptacle 12, which in the embodiment shown is round and is also the shape of the opening in receptacle 12. Lower leaf 16 is provided with a port 36 (FIGS. 2A and 3A) through which receptacle 12 is accessed when the lid is open. The upper edge of the perimeter of lower leaf 16 generally defines plane A (FIG. 16). Upper leaf 18 in a closed position, as shown in FIG. 1A, should completely cover port 36.

Figure 4:
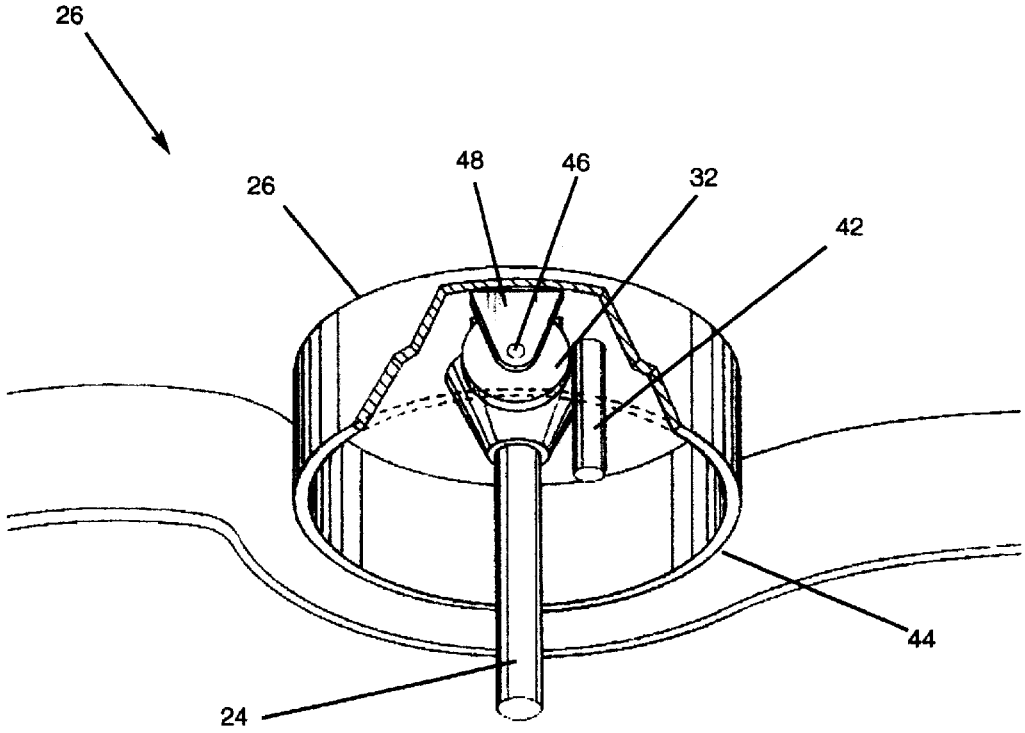
FIG. 4 is a perspective view of the bottom of the upper leaf of the container of FIG. 1A.
Figure 5:
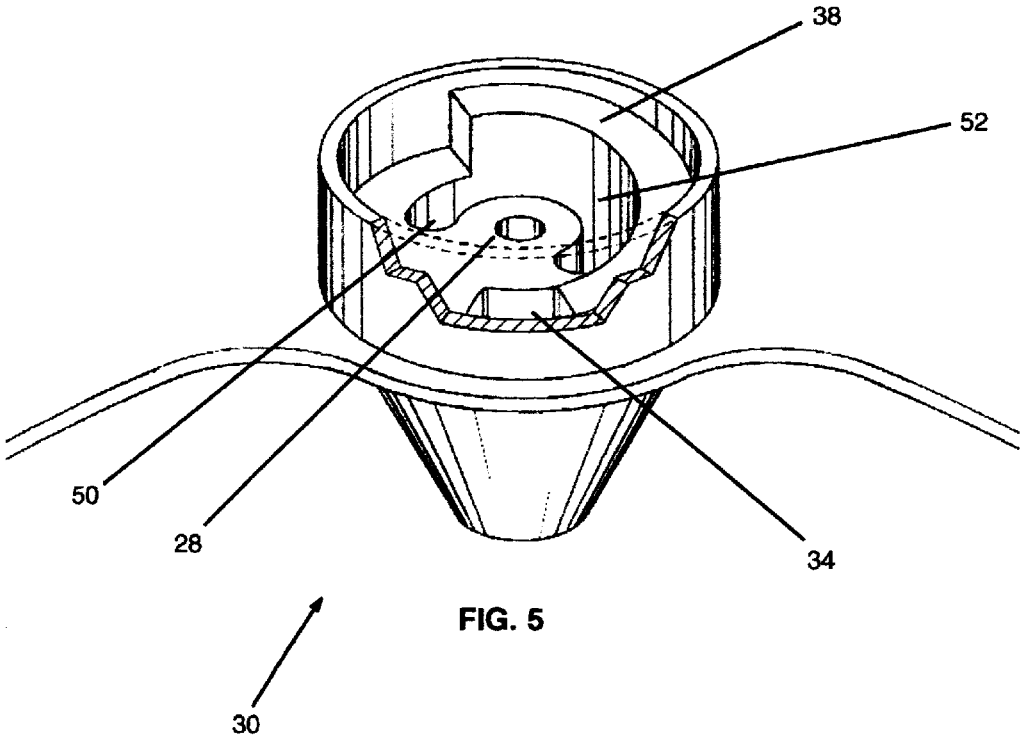
FIG. 5 is a perspective view of the top of the lower leaf of the container of FIG. 1A.
Figure 6A:
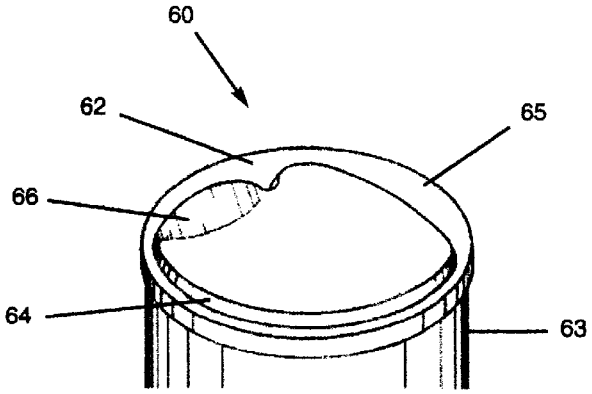
FIG. 6A is a partial perspective view of another preferred embodiment of the container of the invention.
Figure 6B:
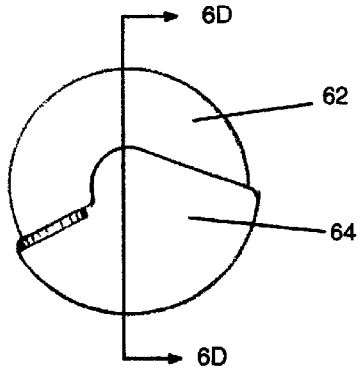
FIG. 6B is a top view of the container of FIG. 6A.
Figure 6C:
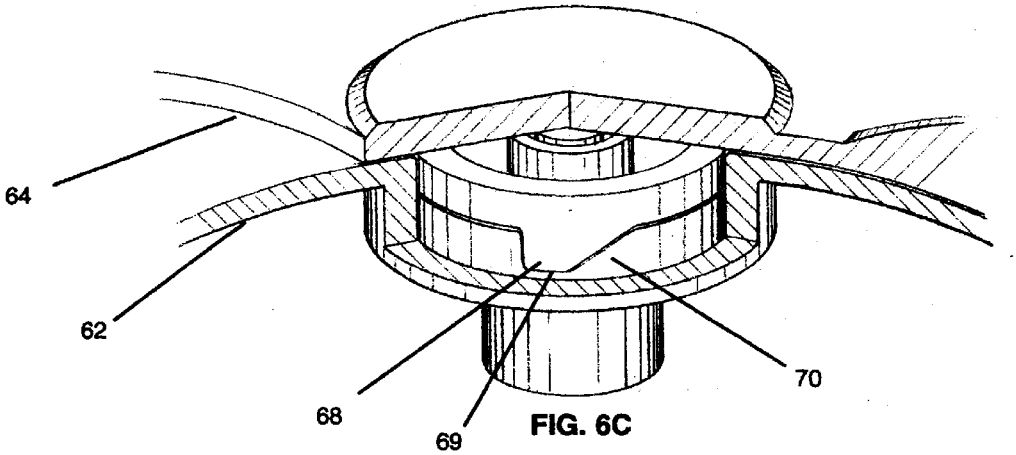
FIG. 6C is an enlarged partial cut-out view of the container of FIG. 6A.
Figure 6D:
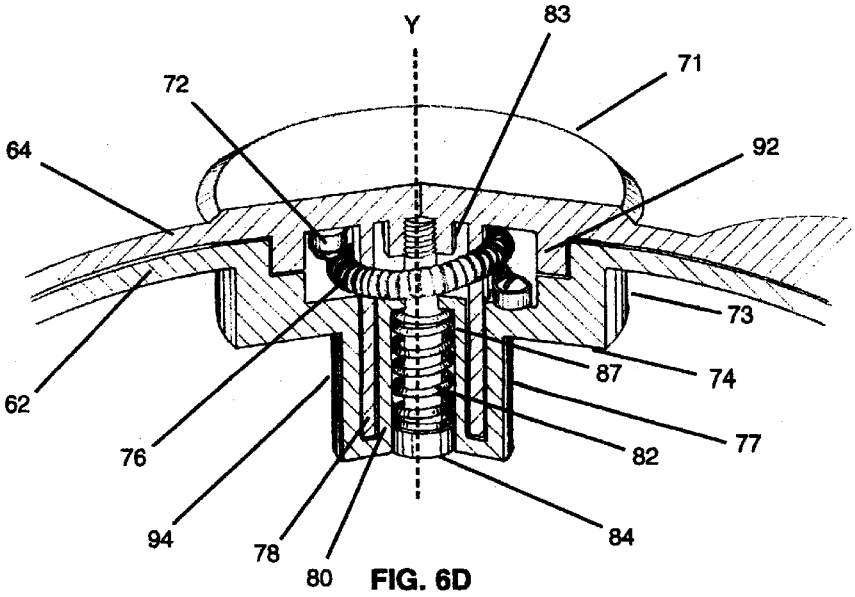
FIG. 6D is an enlarged partial cross-sectional view of the container of FIG. 6B.

Upper leaf 18 is provided with an upper axle assembly 26 (FIG. 4) and lower leaf 16 is provided with a lower axle assembly 30 (FIG. 5).

Upper leaf 18 is adapted to rotate about axis X (FIG. 1C) by a means of rotating. Axis X is substantially perpendicular to the plane defined by the perimeter of lower leaf 16. The term "substantially perpendicular" is used to distinguish the axis X from an axis that is substantially parallel to a plane defined by the perimeter of the lower leaf. For example, as described in the Background section, some known refuse containers comprise a receptacle with a prism-shaped lid having a door that swings to and fro on a horizontal axis. In contrast, the vertically positioned axis of the present design enables the upper leaf to be adapted for use at any number of locations relative to the lower leaf. Axis X may be somewhat off a truly perpendicular line to accommodate modified receptacle and lid shapes.

As shown in FIGS. 1C, 4 and 5, the means for rotating includes ramp 38, which is an integral part of lower axle assembly 30, and wheel 32 which is attached to wheel guides 48 by wheel axle 31, and which, in a closed position, rests in depression 34. When handle 20 is pushed backwards, wheel 32 is lifted up out of depression 34 and rolls upward along ramp 38. The lid is also provided with a means to prevent the upper leaf from over rotating (FIGS. 4 and 5), comprising, interference member 42, which is a protrusion extending downward from the inside surface of upper axle assembly 26 into channel 52 provided in lower axle assembly. As the upper leaf is pushed backward, interference member 42 moves through channel 52 until interference member butts up against backstop 50.

As noted, upper leaf 18 rotates about axis X. To accomplish the rotation, upper axle assembly includes a vertical axle 24 extending downward from the top inside surface of the upper axle assembly. A corresponding axle support member 28 is provided in lower axle assembly 30. Axle support member 28 is a bore having an inside diameter of sufficient breadth to receive axle 24 therethrough without undue clearance.

Figure 15:
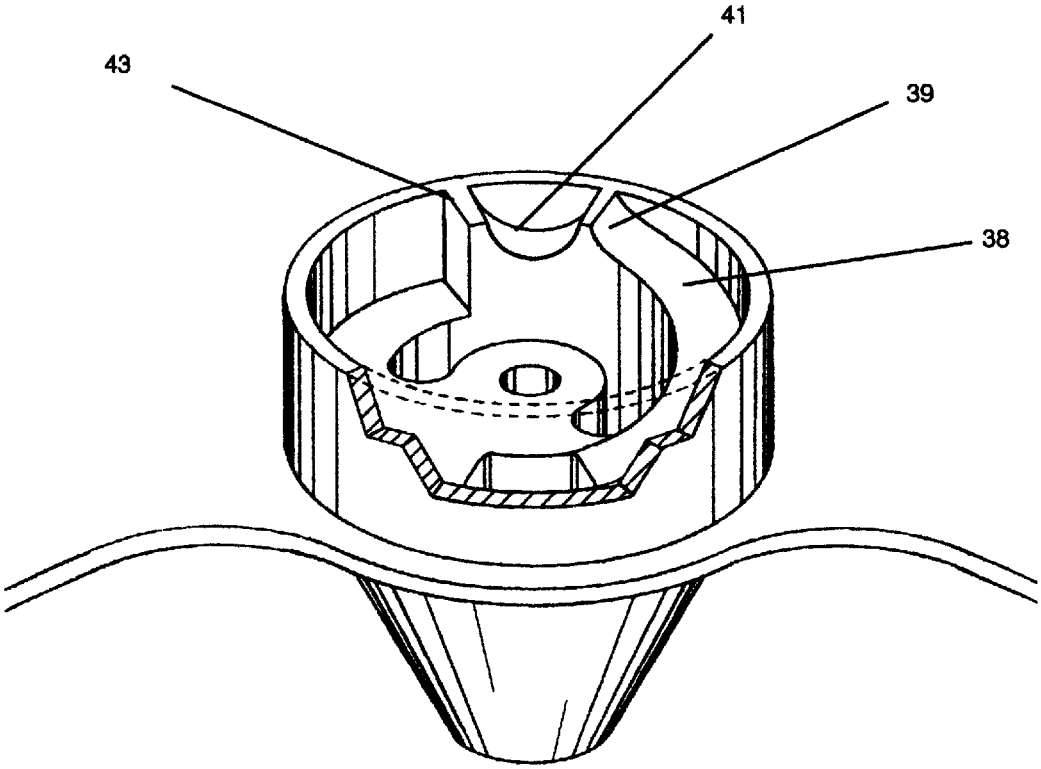
FIG. 15 is a perspective view of the top of the lower leaf of the container as shown in FIG. 5 further comprising a wheel trough and an energy absorbing member.

As shown in FIG. 15, an energy absorbing member 39 may be incorporated into the upper end of ramp 38 to absorb the rotational energy of the upper leaf. Trough 41, defined by backwall 43 and energy absorbing member 39 may also be included and serves to releasably hold the upper leaf in an open position. In normal operation, the upper leaf is pushed open and gravity returns the upper leaf to its closed position when the upper leaf is released. If the upper leaf is rotated with additional force, wheel 32 will drop into trough 41 and remain immobilized until the upper leaf is deliberately rotated in the opposite direction to overcome energy absorbing member 39. The energy absorbing member effectively suspends the upper leaf in an open position for the longest possible period of time before gravity returns the upper leaf to a closed position. Trough 41 makes it possible to leave the upper leaf in an open position indefinitely when needed.

Figure 2B:
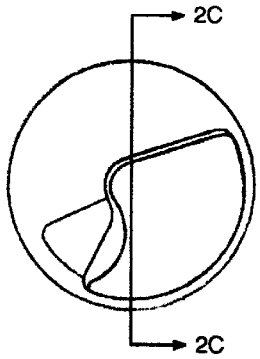
FIG. 2B is a top view of the container of FIG. 2A.
Figure 2C:
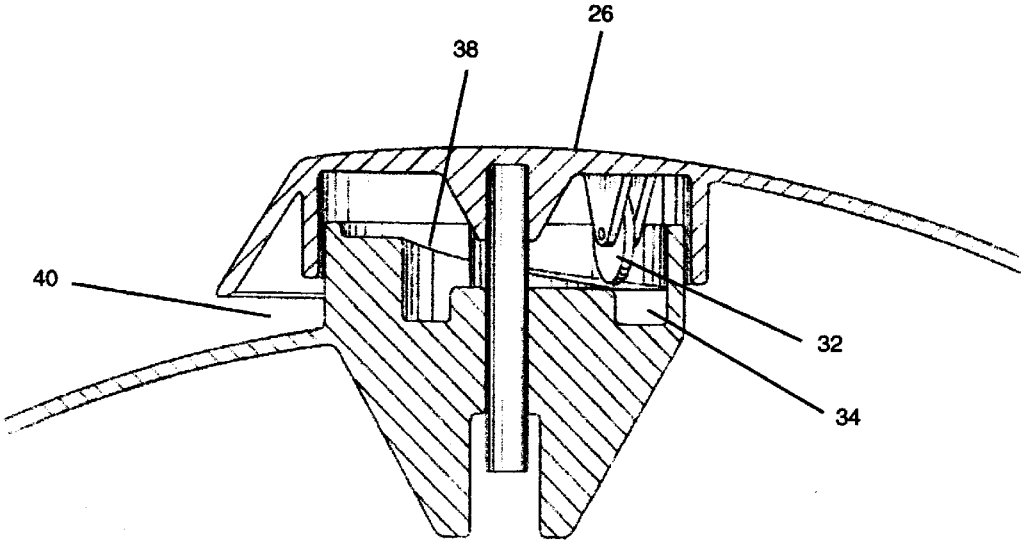
FIG. 2C is an enlarged partial cross-sectional view of the container of FIG. 2B.
Figure 3A:
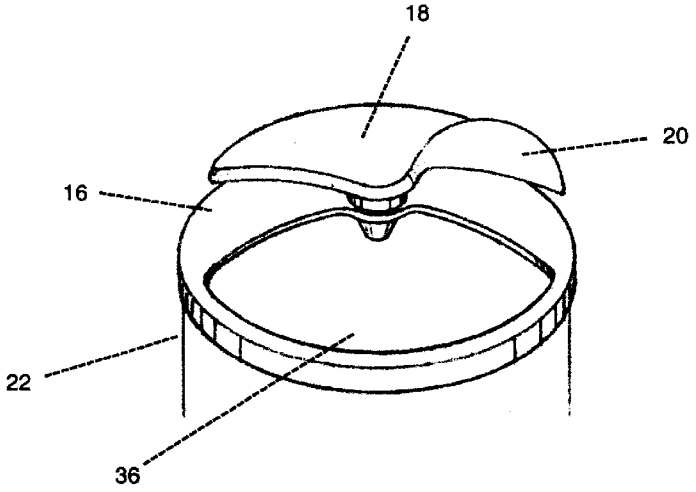
FIG. 3A is a partial perspective view of the container of FIG. 1A, fully opened.
Figure 3B:
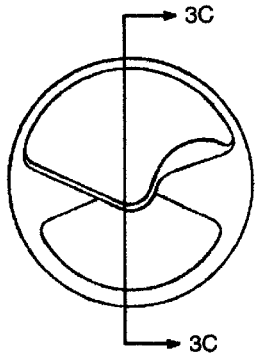
FIG. 3B is a top view of the container of FIG. 3A.
Figure 3C:
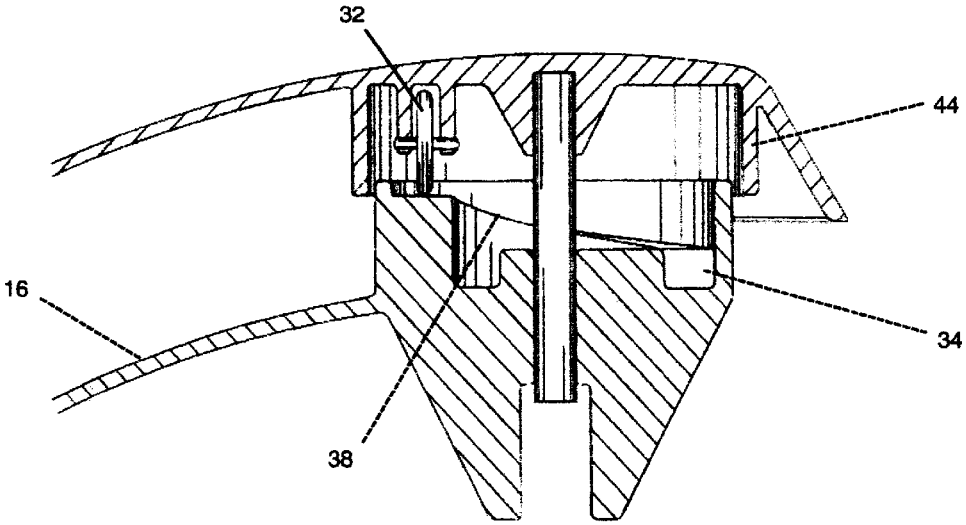
FIG. 3C is an enlarged partial cross-sectional view of the container of FIG. 3B.

FIGS. 2A–2C show the container wherein upper leaf 18 has been rotated open approximately 35 degrees. In this position, wheel 32 has been forced to ride up out of depression 34 in the lower assembly and the entire upper leaf 18 has been raised as shown by clearance area 40. As shown in FIGS. 3A–3C, upper leaf 18 is rotated approximately 180 degrees to its full extent. Gravity will then drive wheel 32 of the upper leaf back down ramp 38 to drop back into depression 34 to remain in the closed position until handle 20 is pushed backward again. Baffles 44 define the perimeter of the upper axle assembly and serve to prevent debris from entering the interior mechanism of the upper and lower axle assemblies.

The invention is used by rotating the handle with the user's hand in a counterclockwise direction. In response, the upper leaf rolls on the wheel, up the ramp in the axis assembly. This rotating and lifting action of the upper leaf exposes the opening in the receptacle. When the handle is released, gravity causes the wheel to roll back down the ramp so that top leaf returns to the closed and sealed position. As the wheel rolls down the ramp to seat in the depression, the upper leaf is lowered to create a seal between the upper and lower leaves.

The handle is typically contacted and pushed by the back of the user's hand while the refuse is dropped into the opening. This design achieves a more sanitary receptacle than the conventional flip door lids wherein the door and the user's hand enter the receptacle to some extent and wherein the refuse usually contacts the door, as well as the user's hand. Thus, the unique handle of the invention, together with the minimal resistance of the lid's vertical axis assembly, provides for a clean, one-handed disposal of the refuse.

Another preferred embodiment of the container of the invention is shown in FIGS. 6A–10 and generally referred to as container 60. Similar to container 10, container 60 is characterized by receptacle 63 having a opening (not shown) and lid 65 which covers the opening of receptacle 63. Lid 65, likewise, has a lower leaf 62 and an upper leaf 64 with handle 66. Lower leaf 62 is provided with a port 86 (FIGS. 7A, 8A and 9A) through which receptacle 63 is accessed when the lid is open. Upper leaf 64 is provided with an upper axle assembly 71 (FIG. 6D) and lower leaf 62 is provided with a lower axle assembly 73 (FIG. 6D).

Upper leaf 64 is adapted to rotate about axis Y (FIG. 6D) by a means of rotating. Container 60's means of rotating differs from that of container 10. Container 60's means of rotating comprises extension spring 76 having two ends, the first of which is secured to lower axle assembly with fastener 74, and the second of which is secured to upper axle assembly with fastener 72. In a clockwise direction from lower fastener 74 to upper fastener 72, extension spring 76 circumscribes the upper portion of vertical axle 78. The means of rotating further comprises tooth member 68, which is integral with baffle 92 of upper axle assembly 71 and adapted to slide up ramp 70 out of depression 69 when handle 66 is pushed backwards.

Lid 65 is also provided with threaded, locking fastener 84 which is passed up through conduit 94 and compression spring 82 within inner chamber wall 80 of lower axle assembly 73 and fixed to upper axle assembly by corresponding threads on the inside surface of inner chamber wall 83 of upper axle assembly 71. As locking fastener 84 is partially screwed into chamber wall 83, vertical axle 78 is guided into circular channel 77 defined by the outer wall of conduit 94 and inner chamber wall 80. Compression spring 82 is squeezed between the lower head 85 of the locking fastener and inner annular shoulder 87 provided at the top end of inner chamber wall 80, which thus exerts a downwards pressure on the upper leaf at the point of connection between locking fastener 84 and the threads on the inside surface of chamber wall 83 of upper axle assembly 71. The locking fastener and the compression spring together act to increase the force of the seal between the upper and lower leaves. However, depending on the materials used to make the lid, the weight of the upper leaf may be sufficient to create an adequate seal.

Figure 7A:
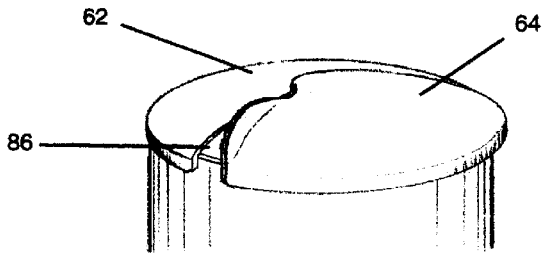
FIG. 7A is a partial perspective view of the container of FIG. 6A, partially open.
Figure 7B:
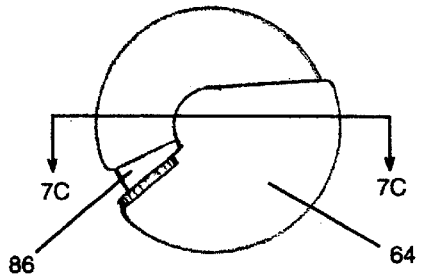
FIG. 7B is a top view of the container of FIG. 7A.
Figure 7C:
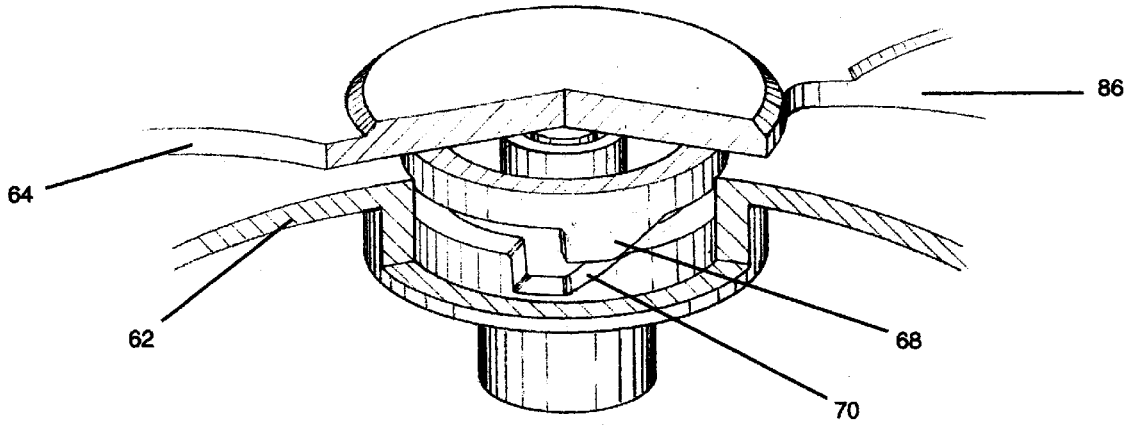
FIG. 7C is an enlarged partial cut-out view of the container of FIG. 7B.
Figure 8A:
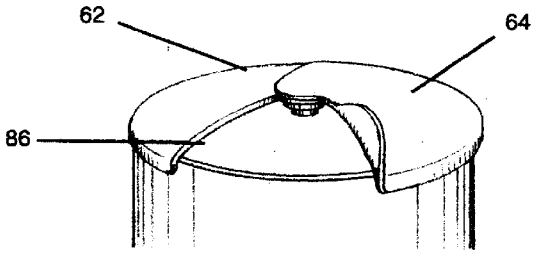
FIG. 8A is a partial perspective view of the container of FIG. 6A in the open position.
Figure 8B:
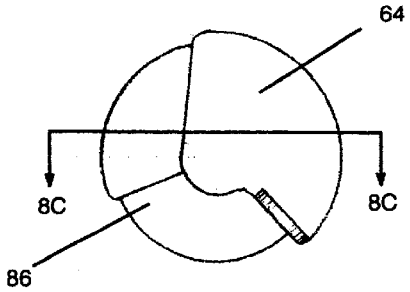
FIG. 8B is a top view of the container of FIG. 8A.
Figure 8C:
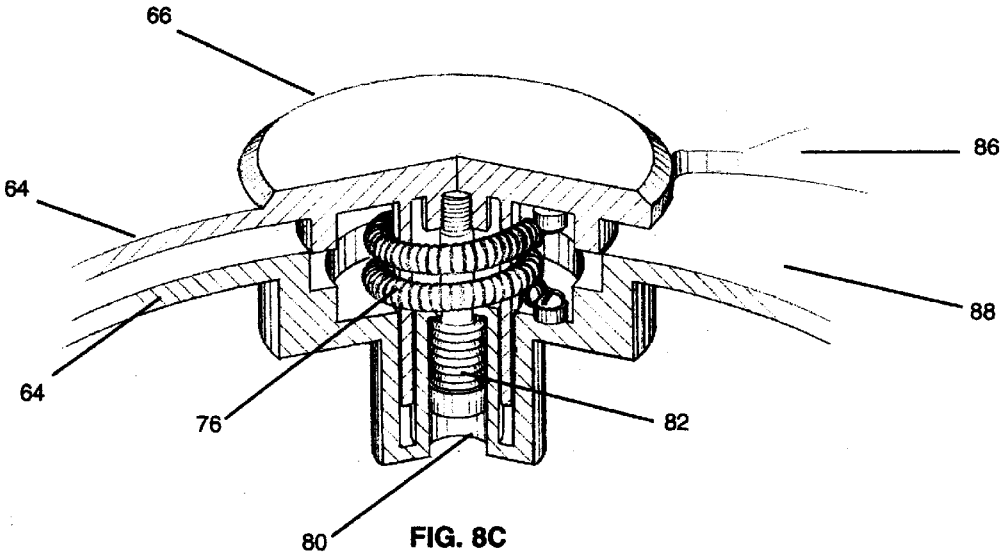
FIG. 8C is an enlarged partial cut-out view of the container of 8B.
Figure 9A:
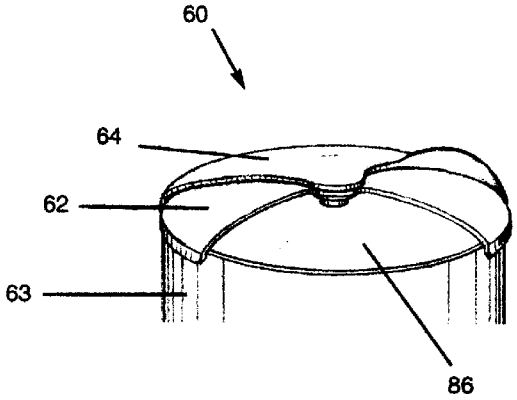
FIG. 9A is an enlarged partial perspective view of the container of FIG. 6A in a locked open position.
Figure 9B:
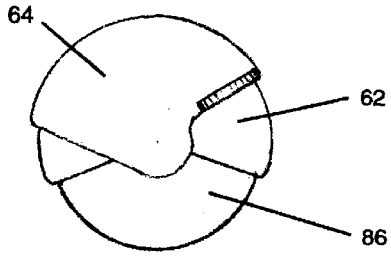
FIG. 9B is a top view of the container of FIG. 9A.
Figure 10:
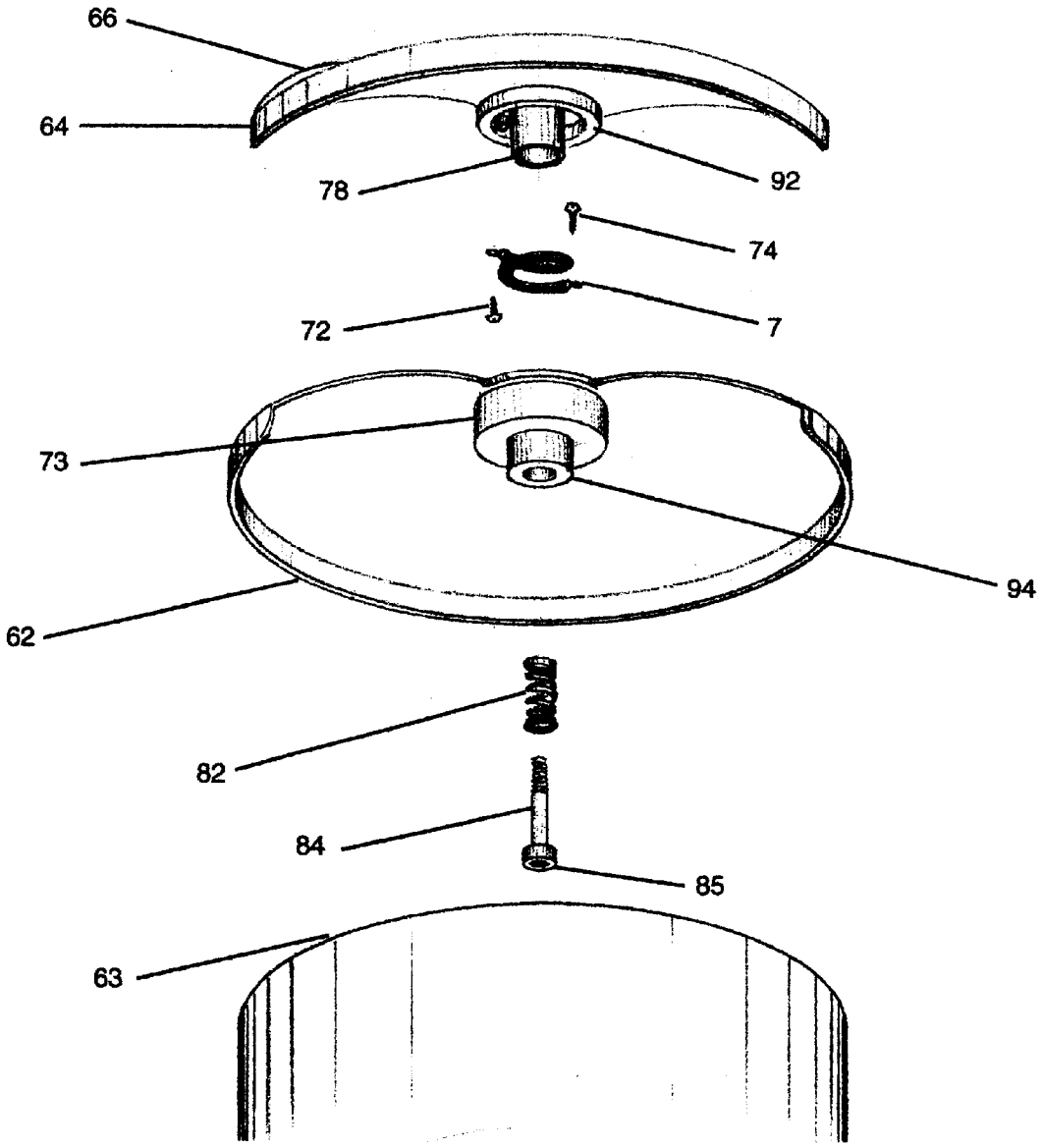
FIG. 10 is an exploded view of the container of FIG. 6A.
Figure 11A:
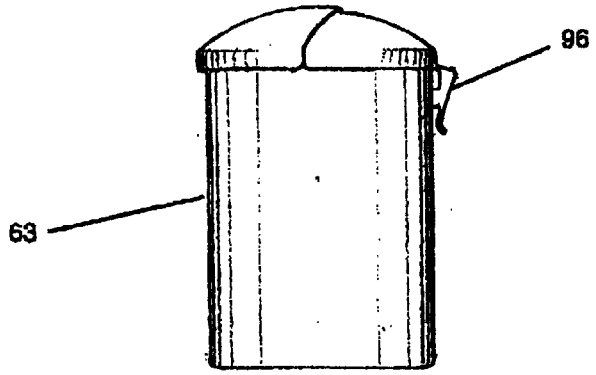
FIG. 11A is a side view of the container of FIG. 6A.
Figure 11B:
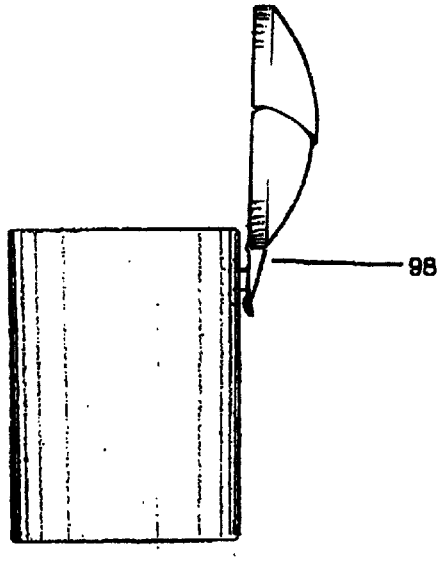
FIG. 11B is a side view of the container of FIG. 11A with the lid up.
Figure 12A:
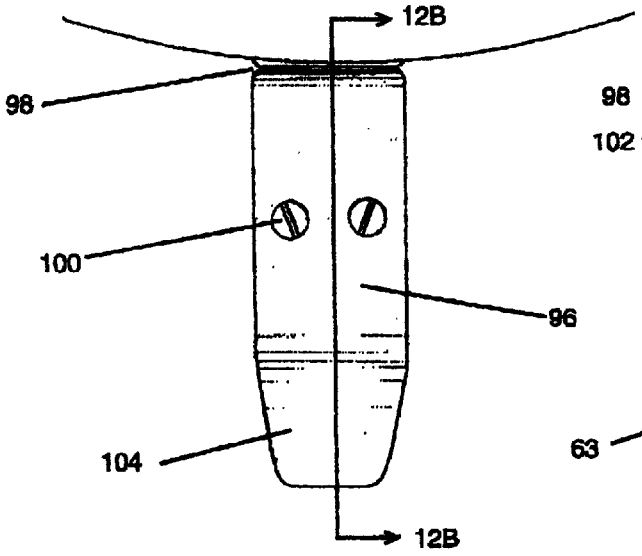
FIG. 12A is an enlarged, partial view of the container of FIG. 11A, featuring the hinge assembly.
Figure 12B:
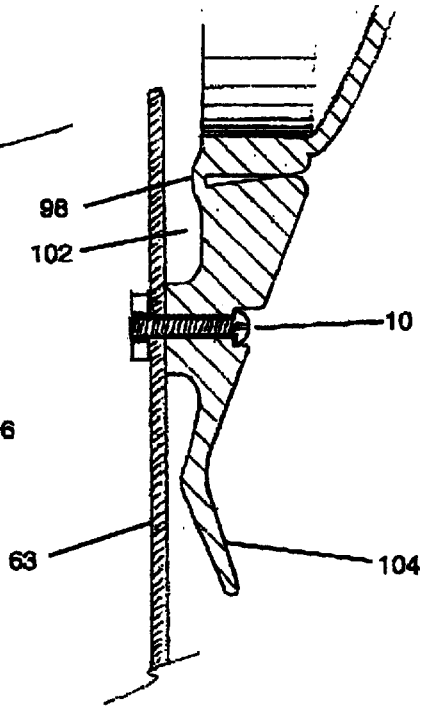
FIG. 12B is a cross-sectional view of the container and hinge as shown in FIG. 12A.
Figure 13:
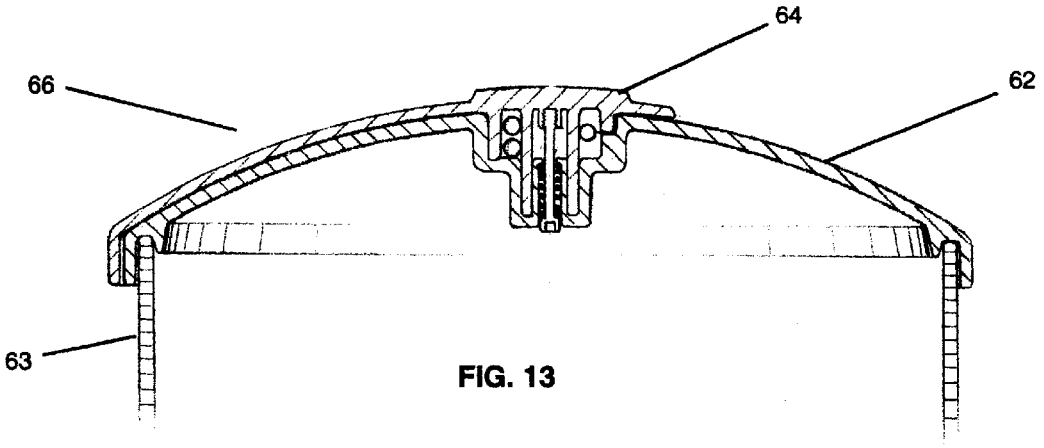
FIG. 13 is a cross-sectional view of the container as shown in FIG. 6A in a closed position.
Figure 14:
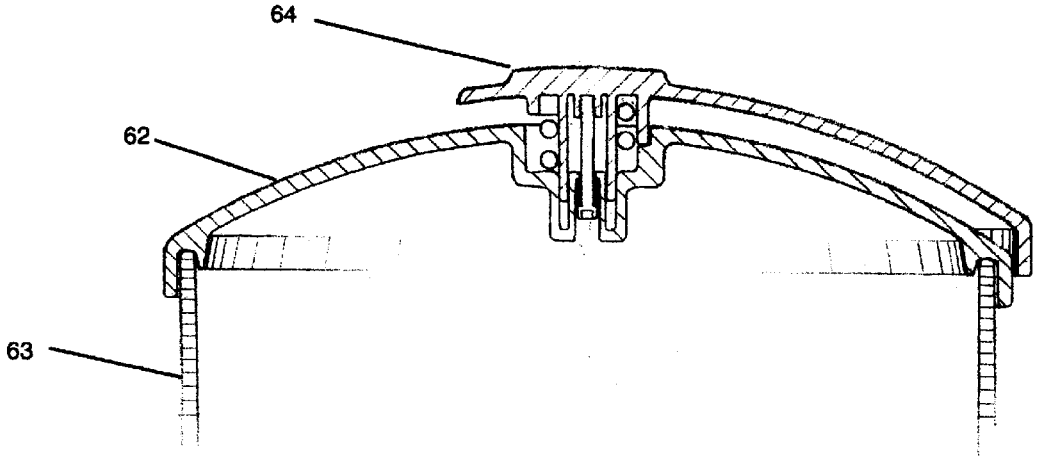
FIG. 14 is a cross-sectional view of the container as shown in FIG. 8A in the opened position.

As shown in FIGS. 7A–7C, upper leaf 64 is partially rotated about its axis so that tooth member 68 is sliding up ramp 70 to reveal a small portion of port 86 through lower leaf 62. As shown in FIGS. 8A–8C, upper leaf 64 is rotated even more to expose a greater portion of port 62 and raised up to create a clearance space 88 between the upper and lower leaves to facilitate easy rotation. Likewise, compression spring 82 is more fully compressed and extension spring 76 is more fully extended. FIGS. 9A and 9B show the lid of the container in a locked open position wherein the upper leaf will not return to a closed position until enough force is exerted on the handle to overcome the resistance mechanism, e.g. trough 41 shown in FIG. 15.

The container of the invention may also be provided with a hinge mechanism to hold the entire lid in an upright, open position to allow the contents of the receptacle to be removed or a refuse bag replaced. For example, as shown in FIGS. 11A–12B, hinge mechanism 96 is fixed to the lid and the receptacle. The hinge mechanism may be integral with the lid, e.g. a living hinge 98, or a separate fixture attached to the lid and to the receptacle. Hinge mechanism 96 is attached in the wall of receptacle 63 using bolts 100 Space 102 is created between the upper edge of receptacle 63 and the hinge attachment to allow for excess bag material. Cleat-like member 104 allows a bag to be pulled tight around the lip of the receptacle.

As noted, the container of the invention is not limited to a refuse container. The container may be adapted for virtually any type of container including, but not limited to, bulk food containers and laundry hampers. The size, shape and type of materials used to make the container will depend on the application.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. An improved container, comprising:

a receptacle having an opening;

a lid adapted to releasably cover at least a portion of the receptacle opening, the lid comprising a lower leaf having a port through which the receptacle opening may be accessed, and an upper leaf which, in a closed position, covers the port in the lower leaf, and which in an open position exposes at least a portion of the port, wherein the upper leaf rotates from the closed to the open position;

a spiraling ramp fixed to the lower leaf, and engaged by a member fixed to the upper leaf, wherein the member moves up the ramp as the upper leaf is moved from the closed position to the open position, and moves down the ramp when the upper leaf is moved from the open position to the closed position.

2. The improved container of claim 1 wherein the lower leaf further comprises a depression for receiving the member when the upper leaf is in the closed position, to assist in maintaining the upper leaf in the closed position.

3. The improved container of claim 1 wherein the lower leaf further comprises a trough for receiving the member when the upper leaf is in the open position, to assist in maintaining the upper leaf in the open position.

4. The improved container of claim 1 wherein the ramp comprises an energy absorbing member.

5. The improved container of claim 1 wherein the member is a wheel.

6. The improved container of claim 1 wherein the member is a tooth member.

7. The improved container of claim 1 further comprising an extension spring having two ends, one end secured to the lower leaf and the other end secured to the upper leaf.

8. The improved container of claim 1 wherein the upper leaf further comprises a security baffle.

9. The improved container of claim 1, further comprising a means to prevent the upper leaf from over rotating.

10. The improved container of claim 9, wherein the means to prevent the upper leaf from over rotating comprises an interference member fixed to the upper leaf, and a back stop provided in the lower leaf.

11. The improved container of claim 1 wherein the upper leaf further comprises an upper axle assembly, and the lower leaf further comprises a lower axle assembly adapted to receive a portion of the upper axle assembly.

12. The improved container of claim 11 wherein the upper axle assembly comprises a downwardly protruding axle, and the lower axle assembly comprises an axle-receiving bore.

13. The improved container of claim 12, further comprising:

a locking fastener provided with a shoulder and adapted to pass through the axle-receiving bore and fix to the upper axle assembly; and a compression spring provided about a portion of the locking fastener and juxtaposed between the shoulder and the axle support member.

14. An improved container, comprising:

a receptacle having a circular upper edge and an opening;

a lid adapted to releasably cover at least a portion of the receptacle opening, the lid comprising a lower leaf having a circular lower edge resting on the receptacle upper edge and defining a plane, and having a port through which the receptacle opening may be accessed, and an upper leaf which, in a closed position, covers the port in the lower leaf, and which in an open position exposes at least a portion of the port, wherein the upper leaf rotates about an axis which is substantially perpendicular to the plane, from the closed to the open position;

a spiraling ramp fixed to the lower leaf, and engaged by a rolling wheel fixed to the upper leaf, wherein the wheel moves up the ramp as the upper leaf is moved from the closed position to the open position, and moves down the ramp when the upper leaf is moved from the open position to the closed position.

15. The container of claim 14, wherein said lower leaf further comprises a depression for receiving said wheel when said upper leaf is in said closed position to releasably maintaining said upper leaf in said closed position; and wherein said upper leaf further comprises a trough for receiving said wheel when said upper leaf is in an open position for realeasably maintaining said upper leaf in said open position.

16. The container of claim 15, wherein said upper axle assembly comprises an axle along said axis and said lower axle assembly comprises a bore adapted to receive at least a portion of said axle.

* * * * *